US011766799B2

(12) United States Patent
Wang et al.

(10) Patent No.: US 11,766,799 B2
(45) Date of Patent: Sep. 26, 2023

(54) MULTI-ADAPTIVE FAST LOADING ATTACHED AIR-COOLED DUST REMOVAL EQUIPMENT

(71) Applicant: DALIAN UNIVERSITY OF TECHNOLOGY, Liaoning (CN)

(72) Inventors: Fuji Wang, Liaoning (CN); Shen Qiu, Liaoning (CN); Rao Fu, Liaoning (CN); Boyu Zhang, Liaoning (CN); Meng Zhao, Liaoning (CN); Wei Liu, Liaoning (CN); Jianwei Ma, Liaoning (CN)

(73) Assignee: DALIAN UNIVERSITY OF TECHNOLOGY, Liaoning (CN)

( * ) Notice: Subject to any disclaimer, the term of this patent is extended or adjusted under 35 U.S.C. 154(b) by 535 days.

(21) Appl. No.: 17/082,881

(22) Filed: Oct. 28, 2020

(65) Prior Publication Data

US 2021/0170619 A1 Jun. 10, 2021

(30) Foreign Application Priority Data

Dec. 9, 2019 (CN) ..... 201911247491.9

(51) Int. Cl.
*B26D 7/18* (2006.01)
*B26F 1/16* (2006.01)
*B26D 7/26* (2006.01)

(52) U.S. Cl.
CPC ..... *B26D 7/1863* (2013.01); *B26F 1/16* (2013.01); *B26D 7/2614* (2013.01)

(58) Field of Classification Search
CPC ..... B26D 7/1863; B26D 7/2614; B26D 9/00; B26D 1/26; B26D 5/02; B26D 5/18; B26D 7/08; B26F 1/16
See application file for complete search history.

(56) References Cited

U.S. PATENT DOCUMENTS 1,451,610 A * 4/1923 Gestas ..... B26F 1/02 408/112
4,981,403 A * 1/1991 Katayama ..... B23Q 5/048 409/137

(Continued)

FOREIGN PATENT DOCUMENTS

CN 104404754 A * 3/2015
CN 106965243 A * 7/2017 ..... B08B 15/04

(Continued)

OTHER PUBLICATIONS

Office Action of corresponding to Chinese application No. 201911247491.9 dated Jul. 13, 2020. (pp. 7).

(Continued)

*Primary Examiner* — Jonathan G Riley
(74) *Attorney, Agent, or Firm* — MUNCY, GEISSLER, OLDS & LOWE, P.C.

(57) ABSTRACT

Multi-adaptive fast loading attached air-cooled dust removal equipment is disclosed. The equipment is mainly composed of five parts: a spindle clamping mechanism, a link mechanism, a bearing connecting mechanism, an axial telescopic mechanism and a dust treatment mechanism. The equipment is connected with a tool holder through an axial connecting mechanism and installed on a machine tool. The axial telescopic mechanism forms a cavity with a processing surface, the gas flow generated by a negative pressure vacuum cleaner forms negative pressure in the cavity, and the telescopic mechanism is fixed to a machine tool spindle housing through the link mechanism to prevent the rotation of the spindle from driving the equipment to rotate and interfere with a workpiece, finally realizing rapid collection and treatment of chips.

1 Claim, 3 Drawing Sheets

(56) References Cited

U.S. PATENT DOCUMENTS

| | | | | | |
|---|---|---|---|---|---|
| 5,245,152 | A * | 9/1993 | McCall | B23H 1/08 | 409/137 |
| 5,791,842 | A * | 8/1998 | Sugata | B23Q 1/0036 | 409/137 |
| 6,394,940 | B1 * | 5/2002 | Sugata | B23Q 11/0046 | 409/137 |
| 8,397,342 | B2 * | 3/2013 | Baker | B25F 5/02 | 15/300.1 |
| 8,651,776 | B2 * | 2/2014 | Khurana | B23Q 11/0046 | 408/239 R |
| 8,696,267 | B2 * | 4/2014 | Khurana | B23Q 11/0046 | 408/239 R |
| 9,539,687 | B2 * | 1/2017 | Hideta | B23Q 11/0046 | |
| 11,220,018 | B2 * | 1/2022 | Kang | B23D 79/00 | |
| 2003/0049085 | A1 * | 3/2003 | Pettersson | B23B 49/02 | 82/1.4 |
| 2008/0216625 | A1 * | 9/2008 | Li | B26D 7/1863 | 83/72 |
| 2016/0172810 | A1 * | 6/2016 | Luo | H01R 39/04 | 310/236 |
| 2022/0161453 | A1 * | 5/2022 | Liao | B26D 7/1863 | |

FOREIGN PATENT DOCUMENTS

| | | | | | |
|---|---|---|---|---|---|
| CN | 105642947 | A | | 7/2018 | |
| CN | 106965249 | B | | 8/2018 | |
| CN | 108789622 | A | * | 11/2018 | B26D 5/04 |
| CN | 112277071 | A | * | 1/2021 | B26D 7/00 |
| CN | 112936425 | A | * | 6/2021 | B26D 7/00 |
| CN | 113172702 | A | * | 7/2021 | B26D 7/02 |
| CN | 214871213 | U | * | 11/2021 | |
| CN | 113910351 | A | * | 1/2022 | |
| CN | 217530165 | U | * | 10/2022 | |
| EP | 1203629 | A1 | * | 5/2002 | B23Q 11/0046 |
| JP | H07204976 | A | * | 8/1995 | |
| WO | WO-0115870 | A2 | * | 3/2001 | B23B 35/00 |
| WO | WO-0132357 | A1 | * | 5/2001 | B23C 5/06 |

OTHER PUBLICATIONS

Notification of Grant of the corresponding to Chinese application No. 201911247491.9 dated Sep. 4, 2020. (pp. 3).

* cited by examiner

MULTI-ADAPTIVE FAST LOADING ATTACHED AIR-COOLED DUST REMOVAL EQUIPMENT

TECHNICAL FIELD

The present invention belongs to the technical field of cutting, and relates to multi-adaptive attached air-cooled dust removal equipment.

BACKGROUND

The use of high-performance composite materials in high-end aerospace equipment can achieve the effect of reducing weight to improve efficiency, which is the performance guarantee of high-end aerospace equipment. In order to realize connection, assembly and other links, the mechanical processing of the composite materials is a necessary process. The main processing forms are drilling holes and milling edges. A large amount of chips generated during processing will not only reduce the processing quality and affect the processing efficiency but also cause irreparable losses in severe cases. For example, dust chips of carbon fiber reinforced plastic composites cannot be excreted from the body after being inhaled, easily causing worker's pneumoconiosis, and can cause wear of moving components such as guideway after falling inside machine tools; and magnetic composite material powder can cause serious damage to circuit boards and moving components after entering machine tools. It can be seen that compared with the traditional metals, composite material chips are obviously different and have more serious problems. The current recycling systems for metal chips usually use compressed air to blow the chips into a chip collection container, and cause powdery chips to be blown to various places inside machine tools and to be more difficult to collect if applied to composite material processing, which will obviously increase the degree of the above hazards, thus being not suitable for composite materials generating powdery chips. For the collection of powdery chips of composite materials, the current device uses a large telescopic dust suction pipe sheathed on the machine tool spindle housing to collect chips but has large volume, needs connecting with a specific structure inside the machine tool, has no generality for a variety of equipment and has complex disassembly. Therefore, a multi-adaptive fast loading chip recovery device suitable for processing of high-performance composite materials is urgently needed.

Aiming at such problems, Chen Liming, et al. from Chongqing University invent "a portable electric drill dust removal device", with the patent number of ZL105642947A, which adopts the technical solution of connecting a fan to the head of a drilling machine, using the fluidity of air and realizing dust suction with a dust hood. The solution is only suitable for manual drilling and cannot be applied to composite material processing on machine tools. Meanwhile, Wang Fuji et al. from Dalian University of Technology propose a "fiber-reinforced composite material processing follow-up reverse suction cooling and dust removal system", with the patent number of ZL201710145631, which forms dust removal for drilling in the X-axis direction and cooling for tools by fixing the device on the spindle and combining an angle head and sealing equipment. However, the mechanism is cumbersome and bulky and thus cannot be applied to various machine tools, workpieces need vertical clamping in use, the usage occasion is limited, and drilling and milling in the Z direction cannot be realized. The content of the invention cannot realize the recovery of the existing chips.

SUMMARY

The present invention mainly solves the technical problem that powdery chips are difficult to quickly collect during machining of composite materials such as fiber composite materials and magnetic composite materials, and proposes rapid dust removal equipment suitable for various machine tools. The equipment is connected with a tool holder through an axial connecting mechanism so as to be installed on a machine tool. Therefore, for various machine tools, generality can be achieved as long as tool holders are of the same specification. During processing, the axial telescopic mechanism forms a cavity with a processing surface, the gas flow generated by a negative pressure vacuum cleaner forms negative pressure in the cavity, and the telescopic mechanism is fixed to a machine tool spindle housing through the link mechanism to prevent the rotation of the spindle from driving the equipment to rotate and interfere with a workpiece, finally realizing rapid collection and treatment of chips. The equipment principle can be simultaneously applied to drilling and milling, and can be realized with only minor changes, which can effectively reduce hazards of chips to human bodies and machine tool equipment and improve the processing quality.

The present invention adopts the following technical solution:

- Multi-adaptive fast loading attached air-cooled dust removal equipment is mainly composed of five parts: a spindle clamping mechanism, a link mechanism, a bearing connecting mechanism, an axial telescopic mechanism and a dust treatment mechanism;
- The spindle clamping mechanism has a bilaterally symmetrical structure, wherein the machine tool spindle housing 1 is clamped and fixed by a left clamping ring A1 and a right clamping ring A2 through bolts and nuts; and the left clamping ring A1 and the right clamping ring A2 have a half-cylindrical thin wall structure, and pin holes A3 are formed in the middle of the left clamping ring A1 and the right clamping ring A2;
- The link mechanism has a bilaterally symmetrical structure and is composed of two groups of links; and a lower link B1 and an upper link B2 are connected through bolts and nuts, the upper end of the upper link B2 is connected with a pin B3 which is inserted into the pin hole A3 to be connected with the spindle clamping mechanism, and the lower end of the lower link B1 is connected with an ear d12 of a telescopic inner ring D1 through bolts and nuts;
- The bearing connecting mechanism C is a mechanism that connects the tool holder 4 and the axial telescopic mechanism, and is composed of an inner expansion sleeve component C1, a rolling bearing C2 and an outer expansion sleeve component C3, wherein the inner expansion sleeve component C1 is sheathed on the tool holder 4, the rolling bearing C2 is sheathed on the inner expansion sleeve component C1, the outer expansion sleeve component C3 is sheathed on the rolling bearing C2, the telescopic inner ring D1 of the axial telescopic mechanism is sheathed on the outer expansion sleeve component C3, and the above parts are connected by interference fit;
- The axial telescopic mechanism is a mechanism that matches with a drill bit to realize axial feeding movement during drilling, and is composed of the telescopic inner ring D1, a telescopic outer ring D2, a spring D3, and an outer ring bottom cover D4; the main body of the telescopic inner ring D1 has a stepped cylindrical structure with thick upper part and thin lower part, the center of the telescopic inner ring D1 is a through hole to accommodate the tool, the upper inside wall is matched with the outer cylindrical surface of the outer expansion sleeve component C3, and the lower outside wall has a plurality of raised sliders d11 distributed annularly; the main body of the telescopic outer ring D2 has a stepped cylindrical structure with thin upper part and thick lower part, the center has a hollow structure to accommodate the axial movement of the tool, the inner wall is provided with a Z-shaped slide d22, and the raised sliders d11 and the Z-shaped slide d22 are used to realize the telescopic function of the axial telescopic mechanism; the inner wall of the telescopic outer ring D2 near the bottom has a concave airway structure d23, a suction hole d21 is formed in the outer wall, the airway d23 is communicated with the suction hole d21, and the spring D3 is sheathed between the telescopic inner ring D1 and the telescopic outer ring D2; and a through hole that can accommodate the diameter of a tool 3 is formed in the center of the outer ring bottom cover D4 which is connected with the telescopic outer ring D2 through threads;

The dust treatment mechanism is mainly composed of a dust suction pipe E1, a negative pressure vacuum cleaner E2 and a dust collection device E3; and the dust suction pipe E1 is connected with the suction hole d21 of the outer ring, one end of the negative pressure vacuum cleaner E2 is connected with the dust suction pipe E1, and the other end is connected with the dust collection device E3; the negative pressure vacuum cleaner E2 forms a negative pressure cavity between the telescopic inner ring D1 and the telescopic outer ring D2 by suction to export chips generated during processing and other impurities through the dust suction pipe E1 into the collection device E3 for storage; and the cooling of a cutting area and the tool 3 is realized by air flow;

During milling, the telescopic outer ring D2 used in drilling is replaced, an outer ring part D5 for milling is used, the overall structure thereof is basically the same as that of the telescopic outer ring D2, and only a slide d51 on the inner wall has an L-shaped structure.

The present invention has the beneficial effect that the device has high integration level, light weight and convenience for installation and can adapt to various processing tools with variable diameters and meet the processing requirements of the existing machine tool equipment. The slide structure of the inner ring and the outer ring can be suitable for tools with various lengths and for tools with various diameters by replacing the outer ring bottom cover. A negative pressure dust treatment mechanism sucks chips in time, effectively reducing hazards of powdery chips to human bodies and machine tools, so as to achieve high-quality and high-efficiency processing of materials. The device realizes timely recovery of chips of composite materials, reduces processing hazards, improves quality stability, and extends the life of machine tools.

DETAILED DESCRIPTION

Detailed description of the present invention is described below in detail in combination with accompanying drawings and the technical solution.

Figure 1:
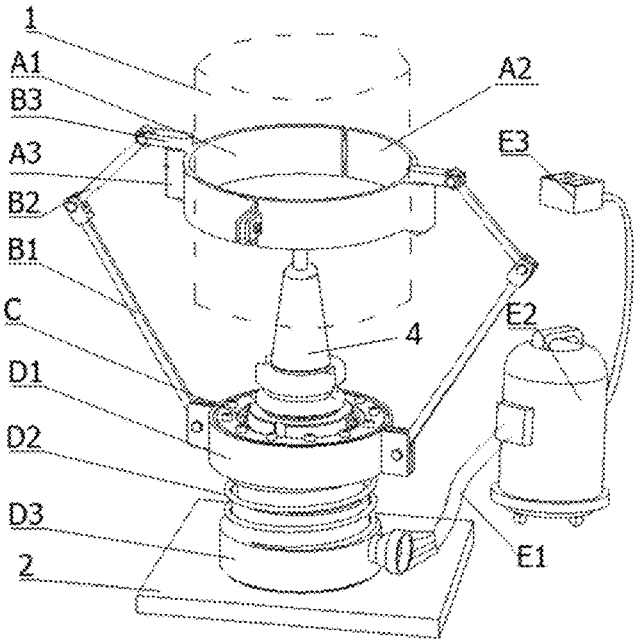
FIG. 1 is an overall structural schematic diagram of equipment, wherein 1—machine tool spindle housing, 2—composite material plate, 4—tool holder, A1—left clamping ring, A2—right clamping ring, A3—pin hole, B1—lower link, B2—upper link, B3—pin, C—bearing connecting mechanism, E1—dust suction pipe, E2—negative pressure vacuum cleaner, and E3—dust collection device.
Figure 2:
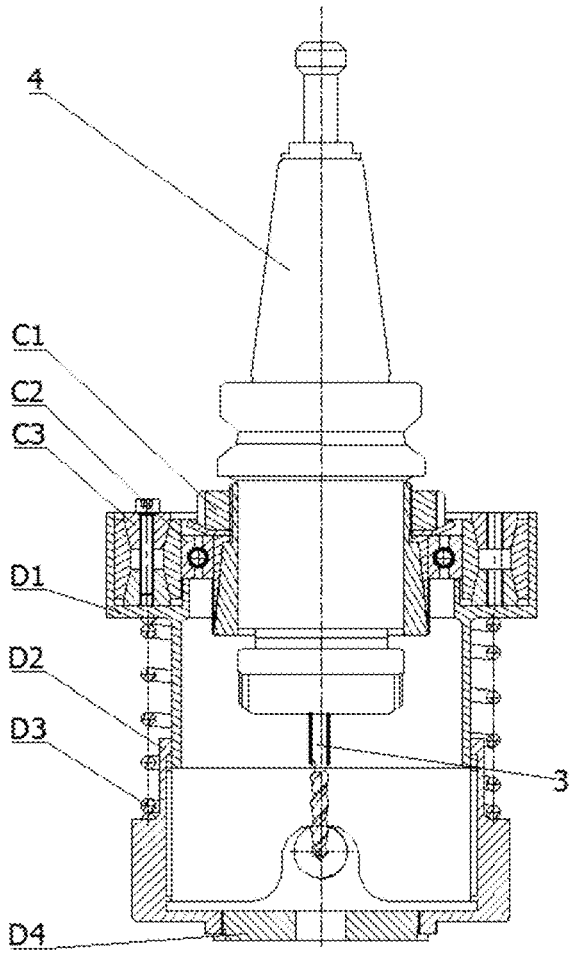
FIG. 2 is a structural sectional view of a bearing connecting mechanism C and an axial telescopic mechanism, wherein 3—tool, 4—tool holder, C1—inner expansion sleeve component, C2—rolling bearing, C3—outer expansion sleeve component, D1—telescopic inner ring, D2—telescopic outer ring, D3—spring, and D4—outer ring bottom cover.
Figure 3:
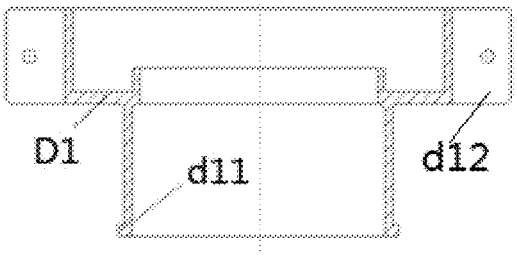
FIG. 3 is a sectional view of a telescopic inner ring D1, wherein d11—raised slider, and d12—ear.
Figure 4:
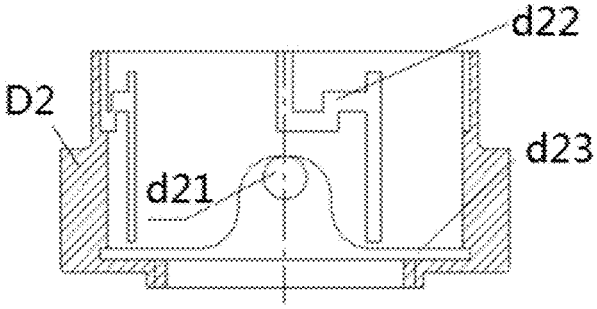
FIG. 4 is a sectional view of a telescopic outer ring D2, wherein d21—suction hole, d22—slide, and d23—airway structure.
Figure 5:
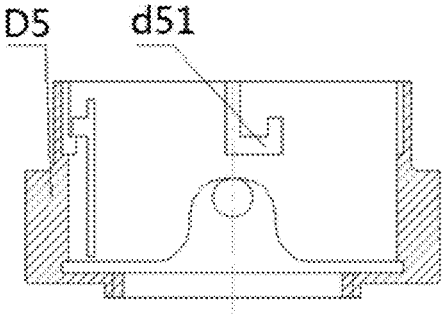
FIG. 5 is a sectional view of an outer ring part D5 for milling, wherein d51—inner wall slide.
Figure 6A:
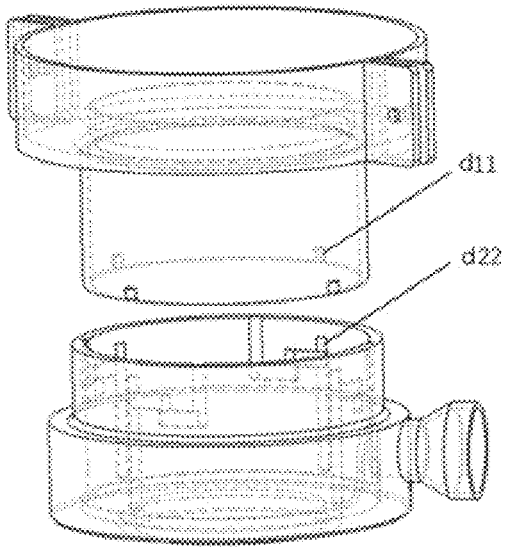
FIG. 6(*a*) is a schematic diagram of matching of raised sliders with a slide, wherein (a) is a schematic diagram of overall matching of raised sliders d11 with a slide d22, FIG. 6(*b*) is a schematic diagram of matching of raised sliders d11 with a slide d22 during drilling, and FIG. 6(*c*) is a schematic diagram of matching of raised sliders d11 with an inner wall slide d51 during milling.
Figure 6B:
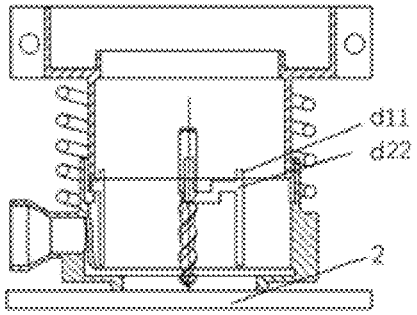
Figure 6C:
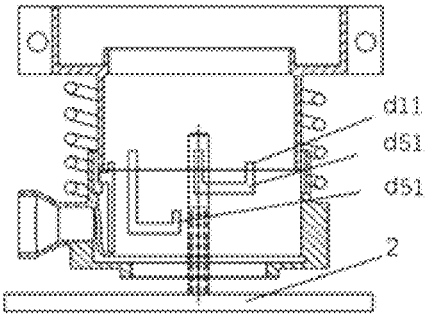

The technical solution adopted by the present invention is multi-adaptive fast loading attached cooled dust removal equipment, which is characterized in that the equipment is mainly composed of five parts: a spindle clamping mechanism, a link mechanism, a bearing connecting mechanism, an axial telescopic mechanism and a dust treatment mechanism, as shown in FIG. 1 and FIG. 2.

The spindle clamping mechanism is connected and fixed to the machine tool spindle housing 1 by a left clamping ring A1 and a right clamping ring A2 through bolts and nuts, the left clamping ring A1 and the right clamping ring A2 respectively have a half-cylindrical thin wall structure, and a pin hole A3 is formed in the middle part of each ring.

The bearing connecting mechanism C is a mechanism that connects a tool holder 4 and the axial telescopic mechanism D, wherein a tool holder 4, an expansion sleeve C1, a rolling bearing C2, an expansion sleeve C3 and the axial telescopic mechanism D are assembled and connected from inside to outside in sequence, and interference connection is realized through the expansion sleeves C1 and C3 to ensure stable connection of the parts;

The axial telescopic mechanism is a mechanism that matches with a drill bit to realize axial feeding movement during drilling, and is composed of a telescopic inner ring D1, a telescopic outer ring D2, a spring D3 and an outer ring bottom cover D4, wherein the main body of the telescopic inner ring D1 has a stepped cylindrical structure with thick upper part and thin lower part, the center is a through hole to accommodate the tool, the upper inside wall is matched with the outer cylindrical surface of the expansion sleeve C3, the central circular boss structure supports the outer ring of the rolling bearing C2, and the lower outside wall has four raised slider structures d11 distributed annularly; the main body of the outer ring part D2 has a stepped cylindrical structure with thin upper part and thick lower part, the center has a hollow structure to accommodate the axial movement of the tool, the inner wall is provided with an inverted S-shaped slide structure d22, the slider structure d11 and the final section of long slide of the slide structure d22 are used to realize the telescopic function of the axial telescopic mechanism, and the inverted S-shaped path of the slide structure d22 can reduce the possibility of direct slippage of the telescopic inner ring D1 and the telescopic outer ring D2. The length of the slide structure d22 needs to match with the length of the tool 3, the clamping length of the tool 3, and the thickness of the composite material plate 2 to be processed so as to ensure that the tool 3 does not exceed the bottom surface of the equipment when drilling is not conducted. Moreover, since the length of the slide structure d22 can meet the need of drilling through the composite material plate 2 in the downward feeding process during processing, the slide structure d22 can be applied to tools 3 with various lengths and composite material plates 2 with different thicknesses by simple modification of the length. The inner wall near the bottom has a concave airway structure d23 which is communicated with the lower suction hole d21 of the outer ring, and the airway structure d23 is recessed to the inner wall to a certain depth so as to avoid covering the airway during the relative axial movement of the telescopic inner ring D1 and the telescopic outer ring D2 to affect the dust suction effect. The spring D3 is sheathed between the telescopic inner ring D1 and the telescopic outer ring D2 to realize automatic reset of moving components during drilling tool retracting. A through hole that can accommodate the diameter of the tool 3 is formed in the center of the outer ring bottom cover D4, the diameter of the through hole can be changed according to different tools used for processing so as to enable the equipment to be suitable for tools with various diameters, and the through hole is connected with the telescopic outer ring D2 through threads.

The link mechanism is composed of two groups of links, the lower link B1, the upper link B2 and the pin B3 are connected through bolts and nuts, and the connection with the spindle clamping mechanism is realized by matching the pin B3 and the pin hole A3 in the spindle clamping mechanism. The lower end of the upper link B2 is connected with an ear d12 of the telescopic inner ring D1 through bolts and nuts; and the lower link B1 is connected with the axial telescopic mechanism through bolts and nuts. The main body of the equipment is connected and fixed to the machine tool spindle housing 1 in this way to avoid the high-speed rotation of the tool 3 and the tool holder 4 during processing to drive the axial telescopic mechanism to rotate, so as to ensure that the lower surface of the equipment is always closely fitted to the composite material plate 2 during drilling to achieve adequate dust suction and cooling.

In the dust treatment mechanism, the dust suction pipe E1 is connected with the suction hole d21 of the outer ring, one end of the negative pressure vacuum cleaner E2 is connected with the dust suction pipe E1, and the other end is connected with the dust collection device E3; and the negative pressure vacuum cleaner E2 forms a negative pressure cavity between the telescopic inner ring D1 and the telescopic outer ring D2 by suction to export chips generated during processing and other impurities through the dust suction pipe E1 into the collection device E3 for storage; and the cooling of a cutting area and the tool 3 is realized by air flow. Accordingly, real-time dust removal can be realized during processing, which is conducive to ensuring a good processing environment and reducing hazards to human health and machine tool equipment.

For milling, only the inner wall slide structure d2 of the telescopic outer ring D2 needs modifying, the telescopic outer ring D2 becomes an outer ring part D5 for milling after modification, and the inner wall slide d51 has an L-shaped structure to slide the slide structure d22 into the final section of the inner wall slide d51. During milling, the equipment integrally hovers over the composite material plate 2 at a certain distance. At this time, no axial relative movement occurs between the telescopic inner ring D1 and the outer ring part D5 to avoid interference between the equipment and the composite material plate 2 caused by the movement along the feeding direction.

The device has high integration level, light weight and convenience for installation and can adapt to various processing tools with different diameters and meet the processing requirements of the existing machine tool equipment. The slide structure of the inner ring and the outer ring can be suitable for tools with various lengths and for tools with various diameters by replacing the outer ring bottom cover. The flexible combination of various structural parts can be suitable for drilling and milling. The negative pressure dust treatment mechanism can suck chips in time, effectively reducing hazards of powdery chips to human bodies and machine tools, so as to achieve high-quality and high-efficiency processing of materials.

The invention claimed is:

1. Multi-adaptive fast loading attached air-cooled dust removal equipment, comprising:

a spindle clamping mechanism, a link mechanism, a bearing connecting mechanism, an axial telescopic mechanism, and a dust treatment mechanism;

the spindle clamping mechanism has a bilaterally symmetrical structure, wherein the machine tool spindle housing is clamped and fixed by a left clamping ring and a right clamping ring through bolts and nuts; and the left clamping ring and the right clamping ring have a half-cylindrical thin wall structure, and pin holes are formed in the middle of the left clamping ring and the right clamping ring;

the link mechanism has a bilaterally symmetrical structure and comprises two groups of links; and a lower link and an upper link are connected through bolts and nuts, the upper end of the upper link is connected with a pin which is inserted into the pin hole to be connected with the spindle clamping mechanism, and the lower end of the lower link is connected with an ear of a telescopic inner ring through bolts and nuts;

the bearing connecting mechanism is a mechanism that connects the tool holder and the axial telescopic mechanism, and comprises an inner expansion sleeve component, a rolling bearing and an outer expansion sleeve component, wherein the inner expansion sleeve component is sheathed on the tool holder, the rolling bearing is sheathed on the inner expansion sleeve component, the outer expansion sleeve component is sheathed on the rolling bearing, the telescopic inner ring of the axial telescopic mechanism is sheathed on the outer expansion sleeve component, and the above parts are connected by interference fit;

the axial telescopic mechanism is a mechanism that matches with a drill bit to realize axial feeding movement during drilling, and comprises the telescopic inner ring, a telescoping outer ring, a spring, and an outer ring bottom cover; the main body of the telescopic inner ring has a stepped cylindrical structure with a thick upper part and a thin lower part, the center of the telescopic inner ring is a through hole to accommodate the tool, the upper inside wall is matched with the outer cylindrical surface of the outer expansion sleeve component, and the lower outside wall has a plurality of raised sliders distributed annularly; the main body of the telescoping outer ring has a stepped cylindrical structure with a thin upper part and a thick lower part, the center has a hollow structure to accommodate the axial movement of the tool, the inner wall is provided with a Z-shaped slide, and the plurality of raised sliders and the Z-shaped slide are used to realize the telescopic function of the axial telescopic mechanism; the inner wall of the telescoping outer ring near the bottom has a concave airway structure, a suction hole is formed in the outer wall, the airway is communicated with the suction hole, and the spring is sheathed between the telescopic inner ring and the telescoping outer ring; and a through hole that can accommodate the diameter of a tool is formed in the center of the outer ring bottom cover which is connected with the telescoping outer ring through threads;

the dust treatment mechanism comprises a dust suction pipe, a negative pressure vacuum cleaner and a dust collection device; and the dust suction pipe is connected with the suction hole of the outer ring, one end of the negative pressure vacuum cleaner is connected with the dust suction pipe, and the other end is connected with the dust collection device; the negative pressure vacuum cleaner forms a negative pressure cavity between the telescopic inner ring and the telescoping outer ring by suction to export chips generated during processing and other impurities through the dust suction pipe into the collection device for storage; and the cooling of a cutting area and the tool is realized by air flow;

during milling, the telescoping outer ring used in drilling is replaced, an outer ring part for milling is used, the telescoping outer ring with a slide on the inner wall having a L-shaped structure.

* * * * *